US007417606B2

(12) United States Patent
Shirasaki

(10) Patent No.: US 7,417,606 B2
(45) Date of Patent: Aug. 26, 2008

(54) DISPLAY APPARATUS AND DRIVING METHOD FOR DISPLAY APPARATUS

(75) Inventor: Tomoyuki Shirasaki, Higashiyamato (JP)

(73) Assignee: Casio Computer Co., Ltd., Tokyo (JP)

( * ) Notice: Subject to any disclaimer, the term of this patent is extended or adjusted under 35 U.S.C. 154(b) by 719 days.

(21) Appl. No.: 10/782,071

(22) Filed: Feb. 18, 2004

(65) Prior Publication Data

US 2004/0165003 A1 Aug. 26, 2004

(30) Foreign Application Priority Data

Feb. 25, 2003 (JP) ..... 2003-047190

(51) Int. Cl.
*G09G 3/10* (2006.01)
*G09G 3/30* (2006.01)

(52) U.S. Cl. ..... 345/76; 345/77; 345/92; 315/169.3

(58) Field of Classification Search ..... 345/55–100; 315/169.3

See application file for complete search history.

(56) References Cited

U.S. PATENT DOCUMENTS

| | | | |
|---|---|---|---|
| 5,680,149 | A | 10/1997 | Koyama et al. |
| 6,023,259 | A | 2/2000 | Howard et al. |
| 6,091,382 | A | 7/2000 | Shioya et al. |
| 6,166,714 | A | 12/2000 | Kishimoto |
| 6,229,506 | B1 | 5/2001 | Dawson et al. |
| 6,373,454 | B1 | 4/2002 | Knapp et al. |
| 6,377,235 | B1 | 4/2002 | Murade et al. |
| 6,522,315 | B2 | 2/2003 | Ozawa et al. |
| 6,577,302 | B2 | 6/2003 | Hunter et al. |
| 6,650,060 | B2 | 11/2003 | Okuda |
| 6,661,180 | B2 | 12/2003 | Koyama |
| 6,667,580 | B2 | 12/2003 | Kim et al. |
| 6,734,636 | B2 * | 5/2004 | Sanford et al. ..... 345/76 |

(Continued)

FOREIGN PATENT DOCUMENTS

EP 10146 501 A1 10/2001

(Continued)

OTHER PUBLICATIONS

Japanese Office Action dated Oct. 9, 2007 (and English translation thereof) which was issued in related U.S. Appl. No. 10/489,381.

*Primary Examiner*—David L Lewis
(74) *Attorney, Agent, or Firm*—Frishauf, Holtz, Goodman & Chick, P.C.

(57) ABSTRACT

A display apparatus includes light-emitting elements each of which is arranged for a pixel circuit and emits light at a luminance corresponding to a driving current. To a signal line through the pixel circuit, is supplied a gray level designation current having a current value larger than that of the driving current during a selection period to store a luminance gray level in the pixel circuit. A first voltage is outputted to the pixel circuit so that the gray level designation current is supplied to the signal line through the pixel circuit during the selection period, and a second voltage is outputted to the pixel circuit during a nonselection period, thereby modulating a current output from the pixel circuit on the basis of the luminance gray level stored in the pixel circuit to supply the driving current to the pixel circuit.

16 Claims, 7 Drawing Sheets

U.S. PATENT DOCUMENTS

| | | | | |
|---|---|---|---|---|
| 6,744,414 | B2 | 6/2004 | Lee et al. | |
| 6,750,833 | B2 * | 6/2004 | Kasai | 345/76 |
| 6,788,003 | B2 | 9/2004 | Inukai et al. | |
| 6,859,193 | B1 | 2/2005 | Yumoto | |
| 6,900,784 | B2 | 5/2005 | Tsuchida | |
| 6,930,680 | B2 * | 8/2005 | Miyazawa | 345/76 |
| 6,943,759 | B2 | 9/2005 | Tam | |
| 6,947,019 | B2 | 9/2005 | Sato et al. | |
| 2001/0017618 | A1 | 8/2001 | Azami | |
| 2001/0035863 | A1 | 11/2001 | Kimura | |
| 2001/0052606 | A1 | 12/2001 | Sempel et al. | |
| 2002/0014852 | A1 | 2/2002 | Bae | |
| 2002/0075208 | A1 | 6/2002 | Bae et al. | |
| 2002/0135309 | A1 | 9/2002 | Okuda | |
| 2002/0163514 | A1 | 11/2002 | Nagai et al. | |
| 2002/0195968 | A1 | 12/2002 | Sanford et al. | |
| 2003/0020335 | A1 | 1/2003 | Komiya | |
| 2003/0098708 | A1 | 5/2003 | Matsueda | |
| 2004/0036664 | A1 | 2/2004 | Miyazawa | |
| 2004/0113873 | A1 | 6/2004 | Shirasaki | |
| 2004/0183791 | A1 | 9/2004 | Yoshida et al. | |
| 2004/0246241 | A1 | 12/2004 | Kazuhito et al. | |
| 2004/0256617 | A1 | 12/2004 | Yamada et al. | |
| 2005/0140610 | A1 | 6/2005 | Smith et al. | |
| 2005/0157581 | A1 | 7/2005 | Shiurasaki et al. | |
| 2005/0219168 | A1 | 10/2005 | Shirasaki et al. | |
| 2006/0119552 | A1 | 6/2006 | Yumoto | |
| 2006/0214890 | A1 | 9/2006 | Morishige et al. | |

FOREIGN PATENT DOCUMENTS

| | | | |
|---|---|---|---|
| EP | 1 170 718 | A1 | 1/2002 |
| EP | 1 372 136 | A1 | 12/2003 |
| EP | 1 443 483 | A2 | 8/2004 |
| JP | 1-123292 | A | 5/1989 |
| JP | 2506840 | B2 | 4/1996 |
| JP | 8-330600 | A | 12/1996 |
| JP | 11-143429 | A | 5/1999 |
| JP | 2000-221942 | A | 8/2000 |
| JP | 2001-147659 | A | 5/2001 |
| JP | 2002-149125 | A | 5/2002 |
| JP | 2002-215095 | A | 7/2002 |
| JP | 2003-066908 | A | 3/2003 |
| JP | 2003-529805 | A | 10/2003 |
| KR | 2000-0071301 | A | 11/2000 |
| WO | WO 99/65011 | A2 | 12/1999 |
| WO | WO 01/06484 | A1 | 1/2001 |
| WO | WO 01/20591 | A1 | 3/2001 |
| WO | WO 01/75852 | A1 | 10/2001 |
| WO | WO 02/39420 | A1 | 5/2002 |
| WO | WO 03/058328 | A1 | 7/2003 |
| WO | WO 2004/001714 | A1 | 12/2003 |

* cited by examiner

DISPLAY APPARATUS AND DRIVING METHOD FOR DISPLAY APPARATUS

CROSS-REFERENCE TO RELATED APPLICATIONS

This application is based upon and claims the benefit of priority from prior Japanese Patent Application No. 2003-047190, filed Feb. 25, 2003, the entire contents of which are incorporated herein by reference.

BACKGROUND OF THE INVENTION

1. Field of the Invention

The present invention relates to a display apparatus having a display panel on which a light-emitting element is formed for each pixel and a driving method for the display apparatus.

2. Description of the Related Art

Examples of conventionally known light-emitting element type display apparatuses, in which light-emitting elements are arrayed in a matrix and caused to emit light to execute display, are an organic EL (ElectroLuminescent) device, inorganic EL and LED (Light Emitting Diode). Especially, active matrix driving light-emitting element type display apparatuses have advantages such as high luminance, high contrast, high accuracy, low power consumption, low profile, and wide view angle. Especially, organic EL elements have received a great deal of attention.

In such a display apparatus, a plurality of scanning lines are formed on a transparent substrate. A plurality of signal lines are also formed on the substrate to run perpendicularly to the scanning lines.

A plurality of transistors are formed in each region surrounded by the scanning lines and signal lines. In addition, one light-emitting element is formed in each region.

In recent years, the light emission efficiency and color characteristic of an organic EL element have greatly increased to the degree that the light emission luminance is almost proportional to the current density. For this reason, an organic EL display apparatus having a high gray level can be designed on the basis of a predetermined standard. According to this standard, a current value necessary for an organic EL element to emit light is about several ten nA (nanoampere) to several μA (microampere) per gray level. For an organic EL element, the driving frequency must be increased as the number of pixels increases. However, when the gray level current that flows in the organic EL element is such a small current, the time constant increases due to the parasitic capacitance in the display apparatus panel. Since it is time-consuming to supply a current having a value corresponding to a desired luminance to the organic EL element, no high-speed operation can be performed. Especially, in displaying a moving image, the image quality greatly degrades. Recently, an organic EL display apparatus that controls the gray level by a current mirror has been proposed (e.g., Jpn. Pat. Appln. KOKAI Publication No. 2001-147659).

The organic EL display apparatus described in this reference comprises an equivalent circuit 102 with current mirror shown in FIG. 7 as an equivalent circuit of a pixel. A signal current flowing in a signal line 704 is set in accordance with the size ratio of transistors 705 and 706 that constitute the current mirror, and is therefore set to be larger than a current value necessary for the organic EL element to emit light.

More specifically, in the equivalent circuit 102 with current mirror, an organic EL element 701, transistors 702 and 707, the transistors 705 and 706 that constitute the current mirror, and a capacitor 709 are arranged for each pixel. The equivalent circuit 102 with current mirror comprises a first scanning driver (not shown) that sequentially selects a first scanning line 703 of each row and a second scanning driver (not shown) that sequentially selects a second scanning line 708 of each row. First, a scanning signal that changes from low level to high level is input to the second scanning line 708 by the second scanning driver to enable a write in the n-channel transistor 707. Subsequently, a scanning signal that changes from high level to low level is input to the first scanning line 703 by the first scanning driver to enable a write in the p-channel transistor 702. A current flows to the transistor 705 and organic EL element 701 in accordance with the current flowing to the signal line 704.

The equivalent circuit 102 with current mirror described in the above reference has the following problems.

One transistor 707 is an n-channel transistor, and the other transistor 702 is a p-channel transistor. For this reason, the manufacturing process becomes complex as compared to the manufacture of single-channel transistors. In addition, since no p-channel material that effectively operates with currently used amorphous silicon has been established yet, a polysilicon must be selected.

Furthermore, in the equivalent circuit 102 with current mirror, five transistors are formed for each pixel. For this reason, the power consumption and manufacturing cost may increase, and the yield may decrease.

The equivalent circuit 102 with current mirror requires two scanning drivers. For this reason, the manufacturing cost of the equivalent circuit 102 with current mirror is high, and the scanning driver mounting area is large.

BRIEF SUMMARY OF THE INVENTION

It is an object of the present invention to provide a display apparatus that realizes low power consumption and manufacturing cost and high yield, and a driving method for the display apparatus.

In order to solve the above problems, the present invention has the following characteristic features. In the following description of means, components corresponding to the embodiment are exemplified in parentheses. Symbols and the like are reference symbols and numerals in the drawing (to be described later).

A display apparatus according to the present invention comprises:

a plurality of pixel circuits (e.g., pixel circuits $D_{1,1}$ to $D_{m,n}$);

a plurality of light-emitting elements (e.g., organic EL elements $E_{1,1}$ to $E_{m,n}$) each of which is arranged for a corresponding one of the pixel circuits and emits light at a luminance corresponding to a driving current;

luminance gray level designation means (e.g., data driver 3) for supplying, to a signal line through the pixel circuit, a gray level designation current having a current value larger than that of the driving current during a selection period to store a luminance gray level of the light-emitting element in the pixel circuit; and current value switching voltage output means (e.g., power supply scanning driver 6) for outputting a first voltage (e.g., potential $V_{HIGH}$) to the pixel circuit to cause the luminance gray level designation means to supply the gray level designation current to the signal line through the pixel circuit during the selection period and outputting a second voltage (e.g., potential $V_{LOW}$) having a potential different from that of the first voltage to the pixel circuit during a nonselection period to modulate a current output from the pixel circuit on the basis of the luminance gray level stored in the pixel circuit to supply the driving current to the pixel circuit.

A display apparatus driving method according to the present invention is a driving method for a display apparatus which comprises a plurality of pixel circuits (e.g., pixel circuits $D_{1,1}$ to $D_{m,n}$) and causes light-emitting elements (e.g., organic EL elements $E_{1,1}$ to $E_{m,n}$) each of which is arranged for a corresponding one of the pixel circuits to emit light in accordance with a predetermined driving current to execute display, comprising steps of:

outputting a first voltage (e.g., potential $V_{HIGH}$) to the pixel circuit to supply a gray level designation current having a current value larger than that of the driving current to a signal line through the pixel circuit during a selection period and store, in the pixel circuit, a luminance gray level of the light-emitting element corresponding to the current value of the gray level designation current; and outputting a second voltage (e.g., potential $V_{LOW}$) having a potential different from that of the first voltage to the pixel circuit during a nonselection period to modulate the driving current output from the pixel circuit on the basis of the luminance gray level stored in the pixel circuit.

A driving current having a current value (e.g., low level of several ten nA to several μA) sufficient for a light-emitting element to emit light can be supplied to the light-emitting element without complicating the arrangement of the display apparatus. Hence, a display apparatus that realizes low power consumption and manufacturing cost and high yield, and a driving method for the display apparatus can be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment to which the present invention is applied will be described below with reference to the accompanying drawing.

Figure 1:
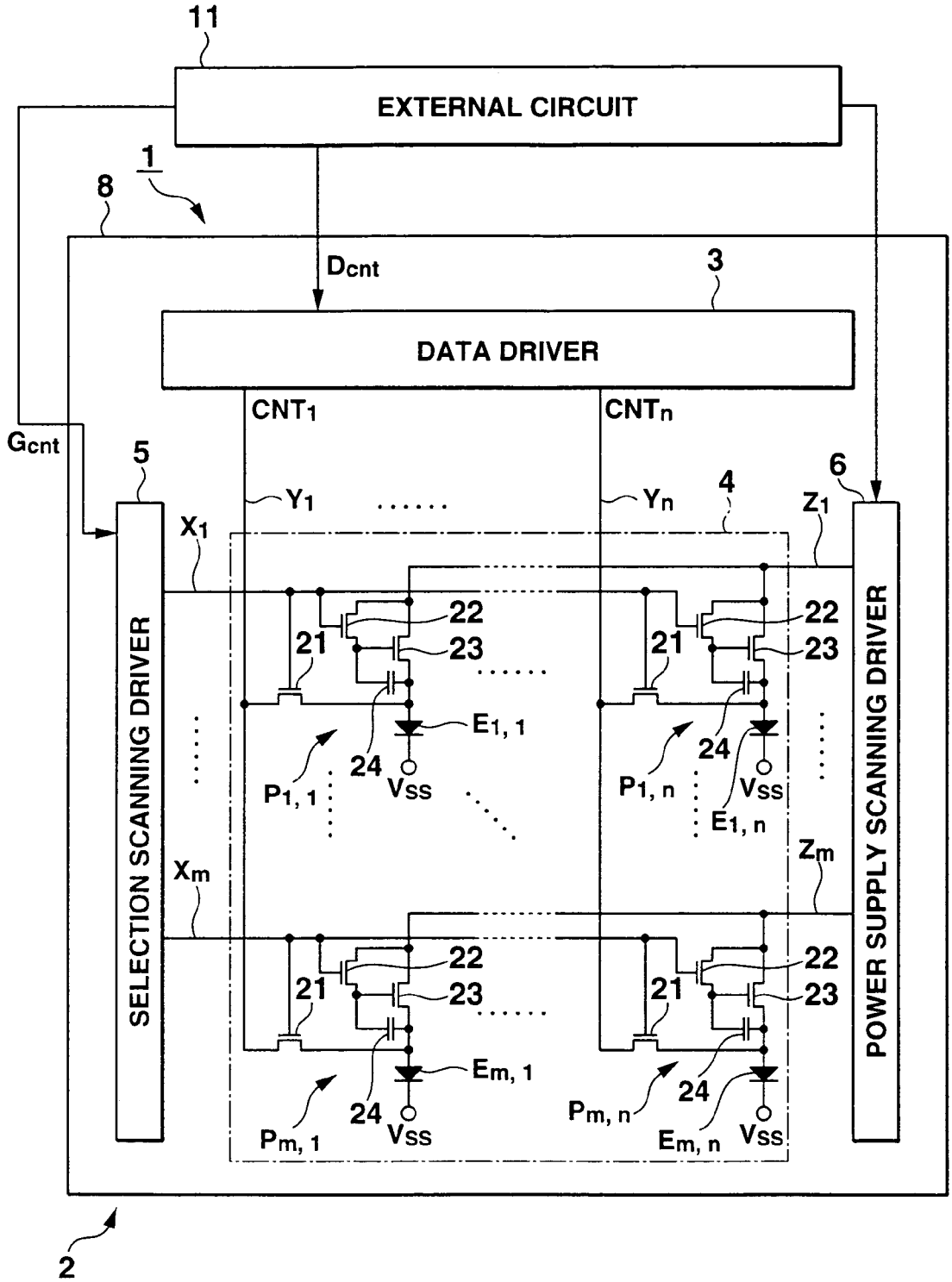
FIG. 1 is a block diagram showing the internal arrangement of an organic EL display apparatus to which the present invention is applied.

FIG. 1 shows the internal arrangement of an organic EL display apparatus 1 to which the present invention is applied. As shown in FIG. 1, the organic EL display apparatus 1 comprises, as basic components, an organic EL display panel 2, a data driver 3 which forcibly supplies a gray level designation current having a current value corresponding to a gray level in accordance with a control signal group $D_{cnt}$ including a clock signal CK1 and luminance gray level signal SC which are input from an external circuit 11, a selection scanning driver 5 which receives a control signal group $G_{cnt}$ including a clock signal CK2 from the external circuit 11, and a power supply scanning driver 6.

The organic EL display panel 2 is constituted by forming, on a transparent substrate 8, a display section 4 that actually displays an image. The selection scanning driver 5, data driver 3, and power supply scanning driver 6 are arranged around the display section 4 on the transparent substrate 8.

The organic EL display panel 2 is designed on the basis of a standard corresponding to the characteristic of organic EL elements $E_{1,1}$ to $E_{m,n}$ in the display section 4. For example, assume that in the organic EL elements $E_{1,1}$ to $E_{m,n}$ of the full-color organic EL display panel 2, the light emission area of one pixel is set to 0.001 to 0.01 $mm^2$, the average value of maximum luminances of each of R, G, and B is 400 $cd/cm^2$, and the current density at this time is 10 to 150 $A/cm^2$. In this case, the displacement current per gray level is a small current of several nA to several μA.

In the display section 4, (m×n) pixels $P_{1,1}$ to $P_{m,n}$ are formed in a matrix on the transparent substrate 8. More specifically, m pixels $P_{i,j}$ are arrayed in the vertical direction (column direction), and n pixels $P_{i,j}$ are arrayed in the horizontal direction (row direction). In this case, m and n are natural numbers, i is a natural number ($1 \leqq i \leqq m$), and j is a natural number ($1 \leqq j \leqq n$). A pixel that is ith from the upper end (i.e., ith row) and jth from the left end (i.e., jth column) is expressed as a pixel $P_{i,j}$.

In the display section 4, m selection scanning lines $X_1$ to $X_m$, m power supply scanning lines $Z_1$ to $Z_m$, and n signal lines $Y_1$ to $Y_n$ are formed on the transparent substrate 8 to be insulated from each other.

The selection scanning lines $X_1$ to $X_m$ run in the horizontal direction parallel to each other. The power supply scanning lines $Z_1$ to $Z_m$ and selection scanning lines $X_1$ to $X_m$ alternate.

The signal lines $Y_1$ to $Y_n$ run in the vertical direction parallel to each other and perpendicular to the selection scanning lines $X_1$ to $X_m$. The selection scanning lines $X_1$ to $X_m$, power supply scanning lines $Z_1$ to $Z_m$, and signal lines $Y_1$ to $Y_n$ are insulated from each other by an interlayer dielectric film (not shown).

The data driver 3, selection scanning driver 5, and power supply scanning driver 6 may be formed either directly on the transparent substrate 8 or on a film substrate (not shown) arranged at the peripheral portion of the transparent substrate 8. In this embodiment, the selection scanning driver 5 and power supply scanning driver 6 are arranged outside two opposing sides of the display section 4 on the transparent substrate 8. The selection scanning lines $X_1$ to $X_m$ are connected to the output terminals of the selection scanning driver 5. The power supply scanning lines $Z_1$ to $Z_m$ are connected to the output terminals of the power supply scanning driver 6.

N pixels $P_{i,1}$ to $P_{i,n}$ arrayed in the horizontal direction are connected to the selection scanning line $X_i$ ($1 \leqq i \leqq m$) and power supply scanning line $Z_i$. M pixels $P_{1,j}$ to $P_{m,j}$ arrayed in the vertical direction are connected to the signal line $Y_j$ ($1 \leqq j \leqq n$). The pixel $P_{i,j}$ is arranged at the intersection between the selection scanning line $X_i$ and the signal line $Y_j$.

Figure 2:
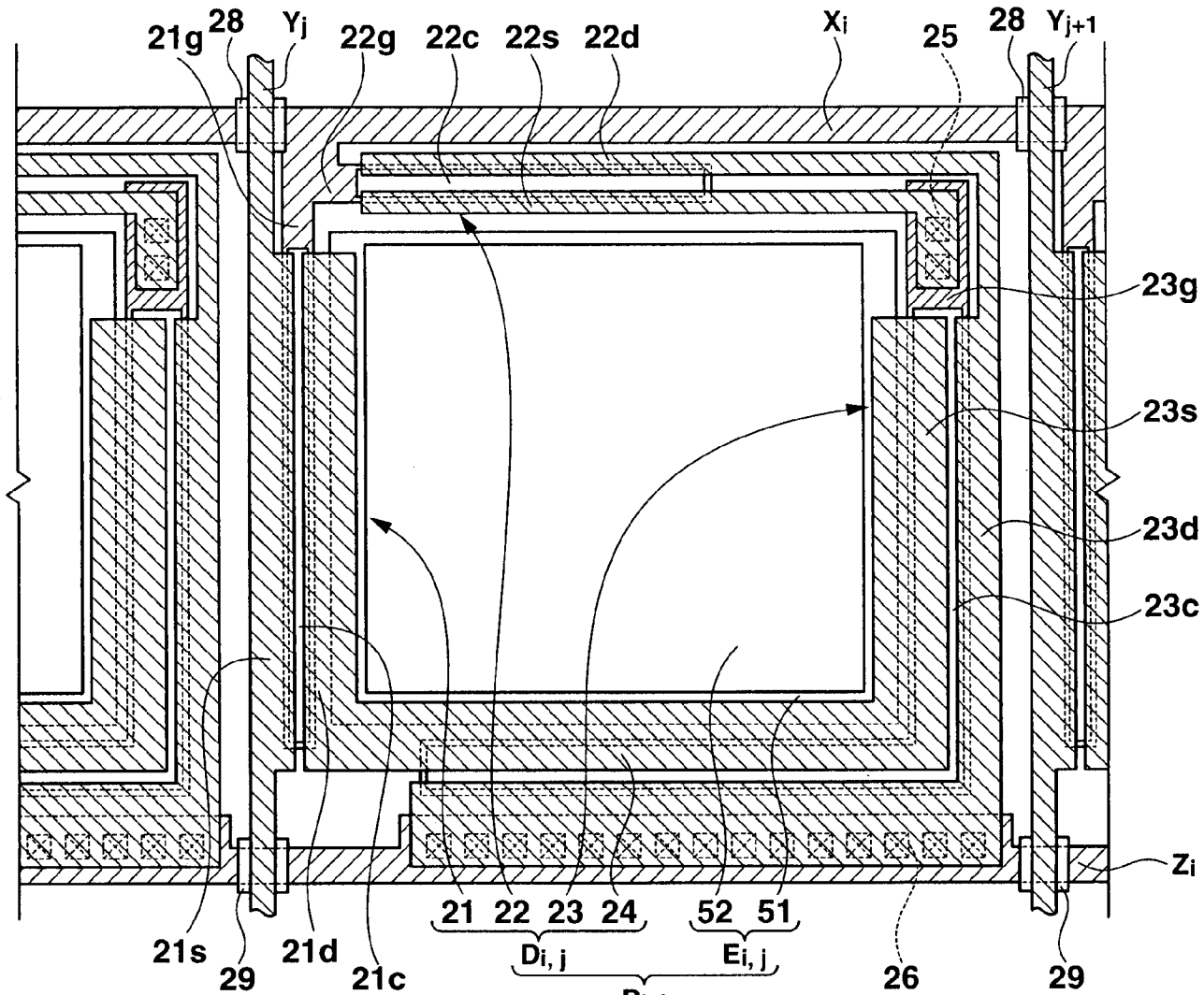
FIG. 2 is a plan view schematically showing one pixel of the organic EL display apparatus shown in FIG. 1.
Figure 3:
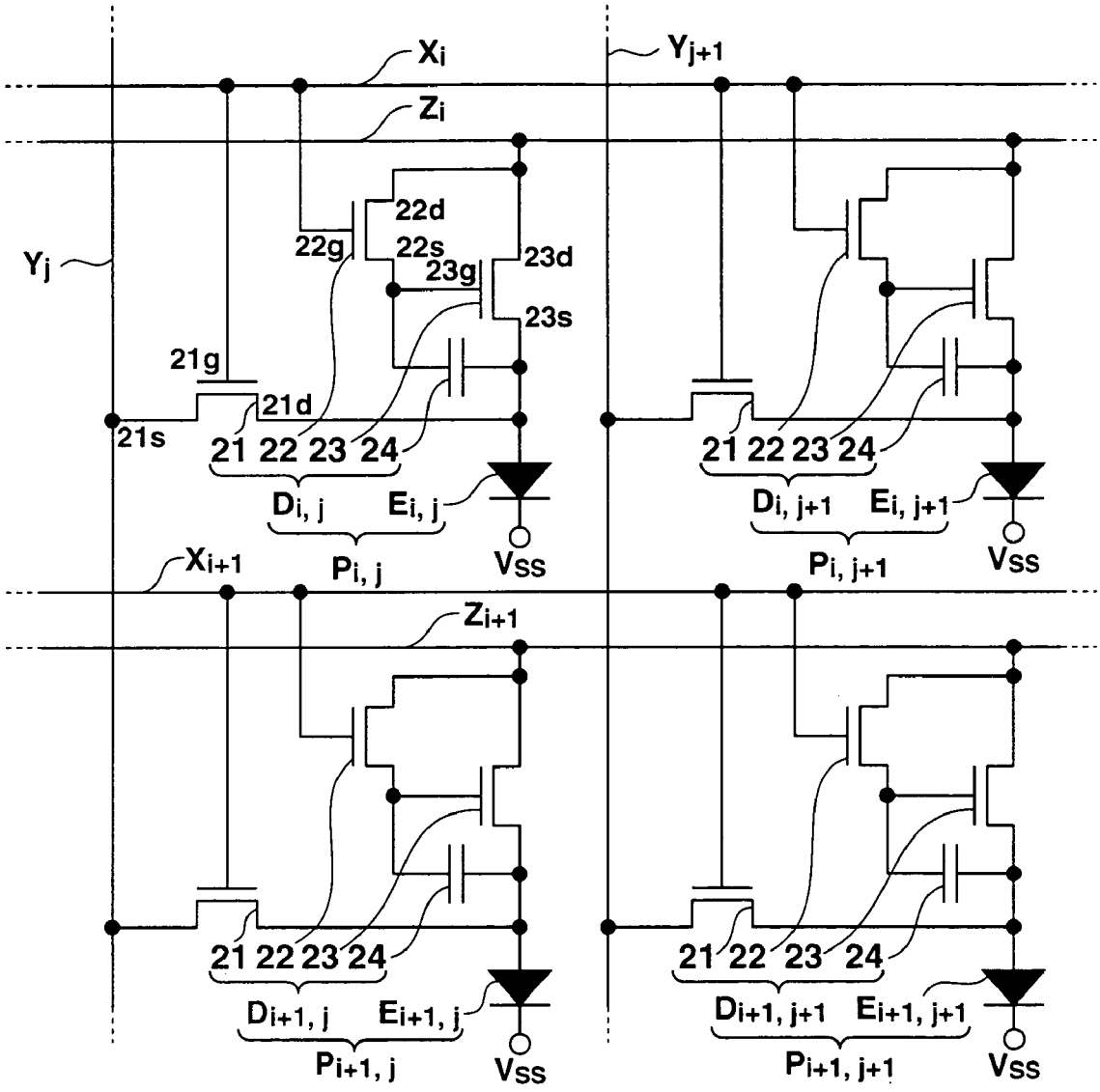
FIG. 3 is a circuit diagram showing an equivalent circuit corresponding to pixels of the organic EL display apparatus shown in FIG. 1.

The pixel $P_{i,j}$ will be described next with reference to FIGS. 2 and 3. FIG. 2 is a plan view schematically showing the pixel $P_{i,j}$. FIG. 3 is a circuit diagram showing an equivalent circuit corresponding to pixels $P_{i,j}$, $P_{i+1,j}$, $P_{i,j+1}$, and $P_{i+1,j+1}$. The gate insulating films of transistors 21, 22, and 23 (to be described later) and the upper electrode (corresponding to a cathode electrode in this embodiment) of each organic EL element are not illustrated.

The pixel $P_{i,j}$ is formed from an organic EL element $E_{i,j}$ which emits light at a luminance corresponding to the level of the driving current and a pixel circuit $D_{i,j}$ arranged around the organic EL element $E_{i,j}$.

The organic EL element $E_{i,j}$ has a multilayered structure in which an anode 51, organic EL layer 52, and cathode (not shown) are sequentially formed on the transparent substrate 8.

The anode 51 is patterned for each of the pixels $P_{1,1}$ to $P_{m,n}$ and formed in each of regions surrounded by the signal lines $Y_1$ to $Y_n$ and selection scanning lines $X_1$ to $X_m$. At each intersection between the signal lines $Y_1$ to $Y_n$ and the selection scanning lines $X_1$ to $X_m$, a semiconductor layer 28 obtained by patterning the same layers as patterned semiconductor layers 21*c*, 22*c*, and 23*c* of the transistors 21, 22, and 23, and their gate insulating films are stacked. Similarly, at each intersection between the signal lines $Y_1$ to $Y_n$ and the power supply scanning lines $Z_1$ to $Z_m$, a semiconductor layer 29 obtained by patterning the same layers as the patterned semiconductor layers 21*c*, 22*c*, and 23*c* of the transistors 21, 22, and 23, and their gate insulating films are stacked.

The anode 51 is conductive and transparent to visible light. The anode 51 is preferably made of a material having a relatively high work function and efficiently injects holes into the organic EL layer 52. The anode 51 is mainly made of, e.g., indium tin oxide (ITO), indium zinc oxide (IZO), indium oxide ($In_2O_3$), tin oxide ($SnO_2$), or zinc oxide (ZnO).

The organic EL layer 52 made of an organic compound is formed on the anode 51. The organic EL layer 52 is also patterned for each of the pixels $P_{1,1}$ to $P_{m,n}$. The organic EL layer 52 may have, e.g., a three-layered structure including a hole transport layer, a light-emitting layer of narrow sense, and an electron transport layer sequentially from the anode 51. Alternately, the organic EL layer 52 may have a two-layered structure including a hole transport layer and a light-emitting layer of narrow sense sequentially from the anode 51, or a single-layered structure including only a light-emitting layer of narrow sense. Alternatively, the organic EL layer 52 may have a multilayered structure in which an electron or hole injection layer is inserted between appropriate layers in one of the above layer structures. The organic EL layer 52 may have any other layer structure.

The organic EL layer 52 is a light-emitting layer of broad sense, which has a function of injecting holes and electrons, a function of transporting holes and electrons, and a function of generating excitons by recombination of holes and electrons and emitting red, green, or blue light. More specifically, when the pixel $P_{i,j}$ is used for red, the organic EL layer 52 of the pixel $P_{i,j}$ emits red light. When the pixel $P_{i,j}$ is green, the organic EL layer 52 of the pixel $P_{i,j}$ emits green light. When the pixel $P_{i,j}$ is blue, the organic EL layer 52 of the pixel $P_{i,j}$ emits blue light.

The organic EL layer 52 preferably contains an electronically neutral organic compound. Accordingly, holes and electrons are injected and transported by the organic EL layer 52 in good balance. An electron transport substance may appropriately be mixed into the light-emitting layer of narrow sense. A hole transport substance may appropriately be mixed into the light-emitting layer of narrow sense. Both an electron transport substance and a hole transport substance may appropriately be mixed into the light-emitting layer of narrow sense.

A cathode is formed on the organic EL layer 52. The cathode may be a common electrode serving as a conductive layer connected to all the pixels $P_{1,1}$ to $P_{m,n}$. Alternately, the cathode may be patterned for each of the pixels $P_{1,1}$ to $P_{m,n}$. In either case, the cathode is electrically insulated from the selection scanning lines $X_1$ to $X_m$, signal lines $Y_1$ to $Y_n$, and power supply scanning lines $Z_1$ to $Z_m$.

The cathode is made of a material having a relatively low work function. The cathode is made of, e.g., indium, magnesium, calcium, lithium, or barium, or an alloy or mixture containing at least one of them. The cathode may have a multilayered structure in which layers of various materials described above are stacked or a multilayered structure in which a metal layer is formed in addition to the layers of various materials described above. More specifically, the cathode may have a multilayered structure in which a metal layer such as an aluminum or chromium layer having a high work function and low resistance is formed on the layers of various materials described above. The cathode preferably has a light shielding effect and high reflectivity to visible light and functions as a mirror surface.

At least one of the anode 51 and cathode may be transparent. More preferably, one electrode is transparent, and the other electrode has a high reflectivity.

As described above, in the organic EL element $E_{i,j}$ having the multilayered structure, when a forward bias voltage (the anode 51 has a higher potential than the cathode) is applied between the anode 51 and the cathode, holes are injected from the anode 51 to the organic EL layer 52, and electrons are injected from the cathode to the organic EL layer 52.

The holes and electrons are transported in the organic EL layer 52 and recombine in it. Accordingly, excitons are generated to excite the phosphor in the organic EL layer 52 so that light is emitted in the organic EL layer 52.

The light emission luminance of the organic EL element $E_{i,j}$ depends on the level of the driving current flowing to it. As the current level increases, the light emission luminance also increases. That is, when the level of the driving current flowing to the organic EL element $E_{i,j}$ is determined, its luminance is uniquely determined.

The pixel circuit $D_{i,j}$ drives the organic EL element $E_{i,j}$ on the basis of signals output from the data driver 3, selection scanning driver 5, and power supply scanning driver 6. Each pixel circuit $D_{i,j}$ comprises the transistors 21, 22, and 23 and a capacitor 24.

Each of the transistors 21, 22, and 23 is an MOSFET having a gate electrode, drain electrode, source electrode, semiconductor layer, impurity semiconductor layer, and gate insulating film and, more particularly, a transistor that uses amorphous silicon for the semiconductor layer (channel region). The transistor may use polysilicon for the semiconductor layer. The transistors 21, 22, and 23 may have an inverted staggered structure or a coplanar structure.

The gate electrode, drain electrode, source electrode, semiconductor layer, impurity semiconductor layer, and gate insulating film of the transistors 21, 22, and 23 have the same compositions. The transistors 21, 22, and 23 are simultaneously formed in the same step but have different shapes, sizes, dimensions, channel widths, and channel lengths.

In this embodiment, the transistors 21, 22, and 23 will be described as n-channel amorphous silicon field effect transistors.

The semiconductor layer 21*c* is arranged between a source electrode 21*s* and a drain electrode 21*d* of the transistor 21 via an impurity semiconductor layer. The semiconductor layer 22*c* is arranged between a source electrode 22*s* and a drain electrode 22*d* of the transistor 22 via an impurity semiconductor layer. The semiconductor layer 23*c* is arranged between a source electrode 23*s* and a drain electrode 23*d* of the transistor 23 via impurity semiconductor layers. One electrode of the capacitor 24 is connected to a gate electrode 23*g* of the transistor 23. The other electrode is connected to the source electrode 23*s* of the transistor 23. A dielectric body is inserted between one electrode and the other electrode. This dielectric body may be the gate insulating film of the transistor 21, 22, or 23. The dielectric body may be the semiconductor layer 23*c* or impurity semiconductor layer of the transistor 23. Alternatively, the dielectric body may contain at least two of the above members.

A gate electrode 22*g* of each transistor 22 is connected to one of the selection scanning lines $X_1$ to $X_m$. The drain electrode 22*d* is connected to one of the power supply scanning lines $Z_1$ to $Z_m$ and the drain electrode 23*d* of the transistor 23. The source electrode 22*s* is connected to the gate electrode 23*g* of the transistor 23 through a contact hole 25 formed in the gate insulating film and to one electrode of the capacitor 24.

The source electrode 23*s* of the transistor 23 is connected to the other electrode of the capacitor 24 and the drain electrode 21*d* of the transistor 21. The drain electrode 23*d* of the transistor 23 is connected to one of the power supply scanning lines $Z_1$ to $Z_m$ through a contact hole 26 formed in the gate insulating film.

A gate electrode 21*g* of the transistor 21 is connected to the selection scanning line $X_i$. The source electrode 21*s* is connected to the signal line $Y_j$. The source electrode 23*s* of the transistor 23, the other electrode of the capacitor 24, and the drain electrode 21*d* of the transistor 21 are connected to the anode 51 of the organic EL element $E_{i,j}$.

The cathode of the organic EL element $E_{i,j}$ is held at a predetermined reference potential $V_{SS}$. In this embodiment, the cathode of the organic EL element $E_{i,j}$ is grounded so that the reference potential $V_{SS}$ is 0 V (volt).

The current vs. voltage characteristic of an n-channel transistor (e.g., the transistor 23, though it may be the transistor 21 or 22) will be described here with reference to FIG. 4. The ordinate represents the drain-to-source current value, and the abscissa represents the drain-to-source voltage value.

Figure 4:
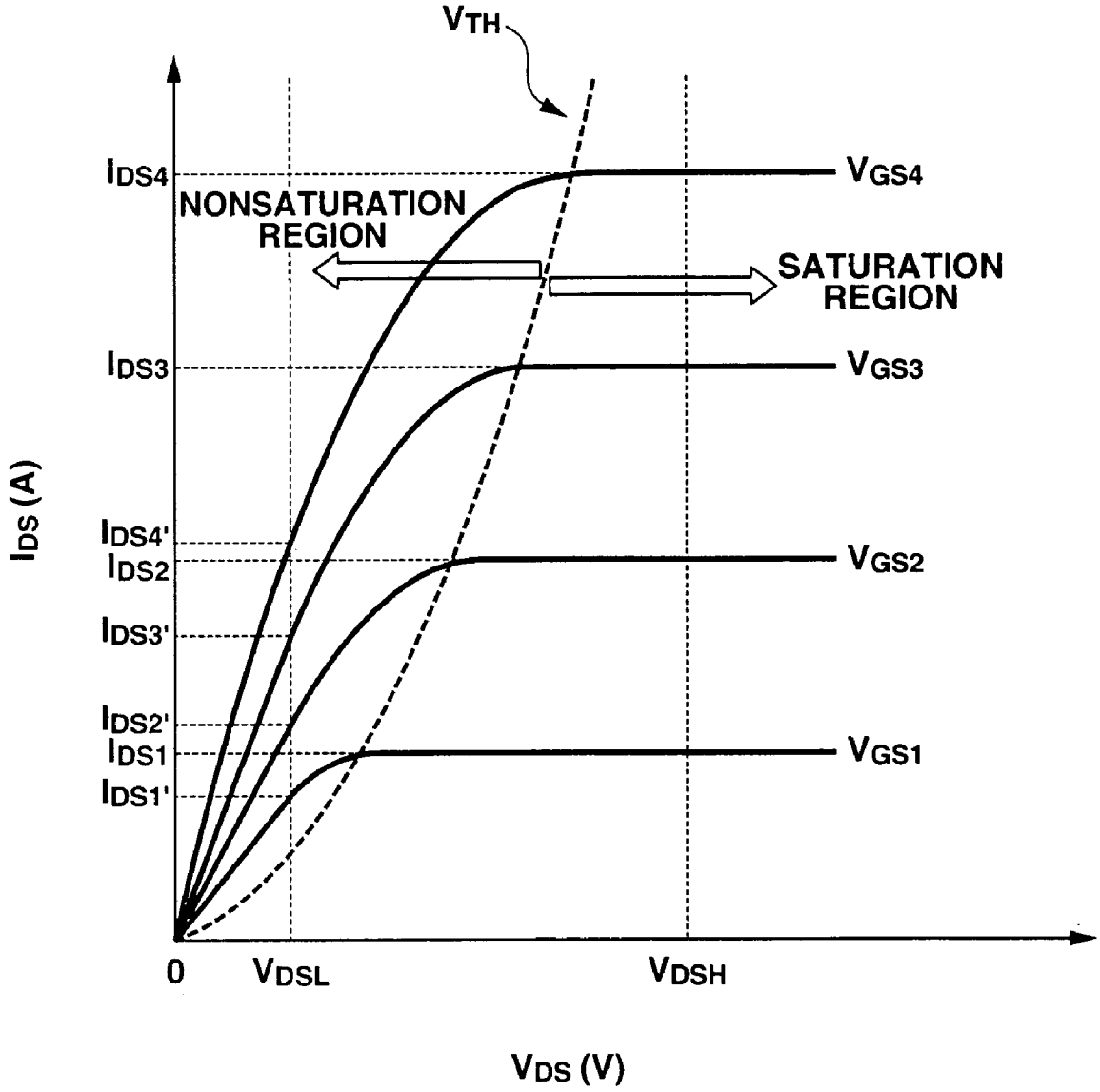
FIG. 4 is a graph showing the current vs. voltage characteristic of an n-channel transistor.

As shown in FIG. 4, in the transistor 23, the correlation between a drain-to-source voltage level $V_{DS}$ and a drain-to-source current level $I_{DS}$ is uniquely determined for each gate-to-source voltage level $V_{GS}$ (e.g., $V_{GS}1$ to $V_{GS}4$).

The gate-to-source voltage levels $V_{GS}1$ to $V_{GS}^4$ correspond to four different gray levels corresponding to the organic EL elements $E_{1,1}$ to $E_{m,n}$. The number of gray levels is to limited to four and may be more or less.

In a saturation region where the drain-to-source voltage level $V_{DS}$ is higher than a drain saturation threshold voltage level $V_{TH}$, the drain-to-source current level $I_{DS}$ indicates a saturation current which is uniquely determined by the gate-to-source voltage level $V_{GS}$.

In a nonsaturation region where the drain-to-source voltage level $V_{DS}$ is lower than the drain saturation threshold voltage level $V_{TH}$, the drain-to-source current level $I_{DS}$ indicates a nonsaturation current which increases/decreases almost in proportion to the drain-to-source voltage level $V_{DS}$ (i.e., almost linearly) under the predetermined gate-to-source voltage level $V_{GS}$.

Hence, to increase/decrease the drain-to-source current level $I_{DS}$ under the predetermined gate-to-source voltage level $V_{GS}$, the drain-to-source voltage level $V_{DS}$ is set to a value sufficiently smaller than the drain saturation threshold voltage level $V_{TH}$. More specifically, the drain-to-source current level $I_{DS}$ that flows in the drain-to-source path of the transistor 23 is increased. In this state, the gate-to-source voltage level $V_{GS}$ is held at a predetermined level. Then, the drain-to-source voltage level $V_{DS}$ is uniquely decreased by a predetermined level. With this operation, the drain-to-source current level $I_{DS}$ that flows between the source and the drain of the transistor 23 can uniquely be decreased.

As described above, in the organic EL display apparatus 1, by setting the drain-to-source voltage level $V_{DS}$ of the transistor 23 to a sufficiently smaller value than the drain saturation threshold voltage level $V_{TH}$, the drain-to-source current level $I_{DS}$ that flows in the drain-to-source path of the transistor 23 can be increased during a selection period $T_{SE}$ (to be described later) and decreased during a nonselection period $T_{NSE}$ (to be described later). Accordingly, even when the parasitic capacitance of the signal lines $Y_1$ to $Y_n$ is large, the time constant that sets the drain-to-source current level $I_{DS}$ of the transistor 23 in a steady state during the selection period $T_{SE}$ can be made smaller. In addition, the drain-to-source current level $I_{DS}$ of small current level suitable for light emission of the organic EL elements $E_{1,1}$ to $E_{m,n}$ can be obtained during the nonselection period $T_{NSE}$.

The data driver 3, selection scanning driver 5, and power supply scanning driver 6 will be described next.

The selection scanning driver 5 is a so-called shift register in which m flip-flop circuits are connected in series. The selection scanning driver 5 applies a selection signal to the selection scanning lines $X_1$ to $X_m$ for a predetermined time at a predetermined period, as shown in FIGS. 1 and 3. More specifically, on the basis of the clock signal CK2 input from the external circuit 11, the selection scanning driver 5 sequentially applies an ON potential $V_{ON}$ as a selection signal of high level to the selection scanning lines $X_1$ to $X_m$ in this order (especially, the selection scanning line $X_1$ next to the selection scanning line $X_m$), thereby sequentially selecting the selection scanning lines $X_1$ to $X_m$. In a nonselection mode, the selection scanning driver 5 applies an OFF potential as a nonselection signal of low level (timing chart shown in FIG. 5).

Figure 5:
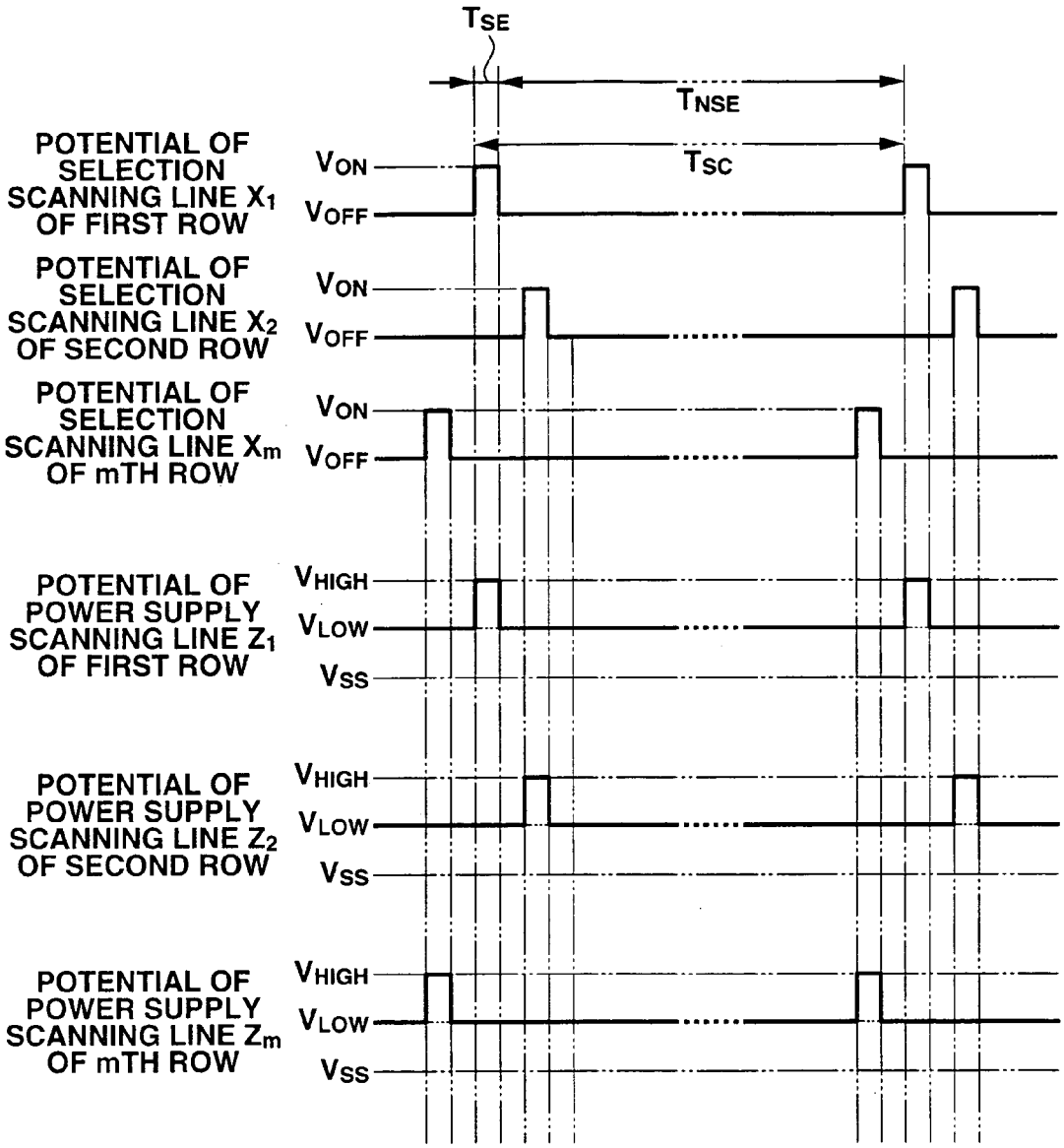
FIG. 5 is a timing chart of signal levels in the organic EL display apparatus shown in FIG. 1.

The power supply scanning driver 6 applies a potential $V_{HIGH}$ of relatively high level and a potential $V_{LOW}$ of relatively low level to the power supply scanning lines $Z_1$ to $Z_m$ for a predetermined time at a predetermined period, as shown in FIGS. 1 and 3 (timing chart shown in FIG. 5). Both of the potentials $V_{HIGH}$ and $V_{LOW}$ are set to be higher than the reference potential $V_{SS}$.

The potential $V_{HIGH}$ has a relatively high level. The potential difference between the potential $V_{HIGH}$ and the reference potential $V_{SS}$ is sufficiently large. Let $V_{DSH}$ be the drain-to-source voltage level of the transistor 23 when the potential $V_{HIGH}$ is applied to the power supply scanning line $Z_i$. The drain-to-source voltage level $V_{DSH}$ is given by $$V_{DSH}=V_{HIGH}-V_E-V_{SS} \quad (1)$$

where $V_E$ is the divided voltage applied to the organic EL element $E_{i,j}$. The drain-to-source voltage level $V_{DSH}$ is set to be higher than the threshold voltage $V_{TH}$ at the gate-to-source voltage level $V_{GS}1$ of the transistor 23 at least for the minimum light emission luminance except non-emission. The drain-to-source voltage level $V_{DSH}$ is preferably set to be higher than a gate-to-source voltage level $V_{GSM}$ Of the transistor 23 at the intermediate gray level and more preferably set to be higher than the threshold voltage $V_{TH}$ at the gate-to-source voltage level $V_{GS}4$ of the transistor 23 at the highest light emission luminance. For this reason, the drain-to-source current level IDS Of the transistor 23 indicates a saturation current or a large current close to it.

On the other hand, the potential $V_{LOW}$ has a relatively low level. The potential difference between the potential $V_{HIGH}$ and the reference potential $V_{SS}$ is small. Let $V_{DSL}$ be the drain-to-source voltage level of the transistor 23 when the potential $V_{LOW}$ is applied to the power supply scanning line $Z_i$. The drain-to-source voltage level $V_{DSL}$ is given by $$V_{DSL}=V_{LOW}-V_E-V_{SS} \quad (2)$$

The drain-to-source voltage level $V_{DSL}$ is set to be lower than the threshold voltage $V_{TH}$ at the gate-to-source voltage level $V_{GS}4$ of the transistor 23 at the highest light emission luminance, as shown in FIG. 4. The drain-to-source voltage level $V_{DSL}$ is preferably set to be lower than the gate-to-source voltage level $V_{GSM}$ of the transistor 23 at the intermediate gray level.

For this reason, when the organic EL element $E_{i,j}$ emits light at least at a certain gray level, the current flowing to the signal line $Y_j$ is sufficiently large during the selection period TSE in which the potential $V_{HIGH}$ is applied while the current flowing to the organic EL element $E_{i,j}$ can be decreased during the nonselection period $T_{NSE}$. More specifically, even when a small current is supplied to the organic EL element $E_{i,j}$ during the nonselection period $T_{NSE}$ in accordance with the characteristic of the organic EL element $E_{i,j}$, the current flowing to the signal line $Y_j$ during the selection period $T_{SE}$ is larger. For this reason, even when the parasitic capacitance of the signal line $Y_j$ is large, no delay occurs. Since the time constant need not be increased, driving at a high frequency is unnecessary, and the power consumption can be suppressed. In addition, an amorphous silicon transistor with a relatively low mobility can be used as the transistors 21 to 23.

As shown in FIGS. 1 and 3, the signal lines $Y_1$ to $Y_n$ are connected to connection terminals CNT1 to CNTn of the data driver 3, respectively. The data driver 3 receives the control signal group $D_{cnt}$ including the clock signal CK1 and luminance gray level signal SC from the external circuit 11. The data driver 3 latches the luminance gray level signal SC at the timing of the received clock signal CK1 and supplies a gray level designation current corresponding to the luminance gray level signal SC from the signal lines $Y_1$ to $Y_n$ to the connection terminals CNT1 to CNTn. More specifically, during each selection period $T_{SE}$ in which the selection scanning lines $X_1$ to $X_m$ are selected, the data driver 3 supplies a gray level designation current from the signal lines $Y_1$ to $Y_n$ to all the connection terminals CNT1 to CNTn in synchronism.

The gray level designation current has a current value (a current value that is larger than the current value of the driving current and is, e.g., several hundred nA to several mA) corresponding to the current value (a relatively small current value of, e.g., several ten nA to several μA) of the driving current that flows to the organic EL elements $E_{1,1}$ to $E_{m,n}$ to cause them to emit light at a luminance corresponding to the luminance gray level signal SC from the external circuit 11. The gray level designation current flows from the signal lines $Y_1$ to $Y_n$ to the connection terminals CNT1 to CNTn.

The operation will be described next. FIG. 5 is a timing chart of the signals in the organic EL display apparatus 1.

As shown in FIG. 5, one of the ON potential $V_{ON}$ (e.g., sufficiently higher than the reference potential $V_{SS}$) as a selection signal of high level and an OFF potential $V_{OFF}$ (e.g., equal to or lower than the reference potential $V_{SS}$) as a selection signal of low level is individually applied by the selection scanning driver 5 to the selection scanning lines $X_1$ to $X_m$ so that the selection scanning lines $X_1$ to $X_m$ are sequentially selected at a predetermined interval/period.

More specifically, during the selection period $T_{SE}$ of the ith row in which the selection scanning line $X_i$ is selected, the ON potential $V_{ON}$ is applied by the selection scanning driver 5 to the selection scanning line $X_i$, and the potential $V_{HIGH}$ is applied to the power supply scanning line $Z_i$. Accordingly, the transistors 21 and 22 (the transistors 21 and 22 of the pixel circuits $D_{i,1}$ to $D_{i,n}$) connected to the selection scanning line $X_i$ are turned on. At this time, the voltage $V_{DSH}$ is applied between the source electrode 23*s* and the drain electrode 23*d* of the transistor 23 so that a saturation current or a current having a relatively large current value close to the saturation current flows. For this reason, when the transistors 21 and 22 are turned on, the gray level designation current starts flowing to the signal line $Y_j$ through the transistor 23. When the gray level designation current starts flowing, the capacitor 24 between the gate electrode 23*g* and the source electrode 23*s* of the transistor 23 is so charged up as to flow a gray level designation current between the source electrode 23*s* and the drain electrode 23*d* of the transistor 23 in a steady state. Since the current that flows between the source electrode 23*s* and the drain electrode 23*d* of the transistor 23 is a saturation current or a current having a relatively large current value close to the saturation current, the capacitor 24 can quickly be charged up.

On the other hand, the nonselection period $T_{NSE}$ is set for rows corresponding to the selection scanning lines $X_1$ to $X_{i-1}$ and $X_{i+1}$ to $X_m$ except the selection scanning line $X_i$. Since the OFF potential $V_{OFF}$ is applied to these selection scanning lines by the selection scanning driver 5, the transistors 21 and 22 except those of the pixel circuits $D_{i,1}$ to $D_{i,n}$ are turned off, and no gray level designation current flows. A period represented by $T_{SE}+T_{NSE}=T_{SC}$ is one vertical period. The selection periods $T_{SE}$ of the selection scanning lines $X_1$ to $X_m$ do not overlap. "$T_{SE}$", "$T_{NSE}$", and "$T_{SC}$" shown in FIG. 5 are for only the selection scanning line $X_1$ of the first row.

A time interval is prepared after the selection scanning driver 5 applies the ON potential $V_{ON}$ to the selection scanning line $X_i$ until the selection scanning driver 5 applies the ON potential $V_{ON}$ to the next selection scanning line $X_{i+1}$.

When the pixel circuits $D_{i,1}$ to $D_{i,n}$ shift to the nonselection period $T_{NSE}$ of the ith row, the OFF potential $V_{OFF}$ is applied by the selection scanning driver 5 to the selection scanning line $X_i$ so that the charge of the capacitor 24 is held. In addition, the power supply scanning line $Z_i$ is shifted from the potential $V_{HIGH}$ to the lower potential $V_{LOW}$. Hence, the drain-to-source voltage level of the transistors 23 of the pixel circuits $D_{i,1}$ to $D_{i,n}$ shifts from $V_{DSH}$ to $V_{DSL}$. For example, assume that charges corresponding to the gate-to-source voltage level $V_{GS}4$ of the transistor 23 of the pixel circuit $D_{i,j}$ are charged up in the capacitor 24, as shown in FIG. 4. At this time, when the drain-to-source voltage level of each transistor 23 is $V_{DSH}$, i.e., during the selection period $T_{SE}$, the current level $I_{DS}$ of the current that flows in the drain-to-source path of the transistor 23 is $I_{DS}4$. However, during the nonselection period $T_{NSE}$, the drain-to-source voltage level of the transistor 23 is $V_{DSL}$. Hence, the current that the transistor 23 supplies drops to a lower current level $I_{DS}$4'. Hence, the current level $I_{DS}$4' flows to the organic EL element $E_{i,j}$ to cause it to emit light. $I_{DS}$k and the current level $I_{DS}$k' are set to always correspond with each other in a one-to-one correspondence. Hence, when $I_{DS}(k-1)<I_{DS}k$, $I_{DS}(k'-1)<I_{DS}k'$.

As described above, when the current value between the anode and the cathode of the organic EL element $E_{i,j}$, which is necessary for the organic EL element $E_{i,j}$ to emit light at a desired light emission luminance during the nonselection period $T_{NSE}$, is $I_{DS}k'$, the saturation current $I_{DS}k$ is supplied between the source and the drain of the transistor 23 during the immediately preceding selection period $T_{SE}$. For this purpose, to set the drain-to-source voltage of the transistor 23 during the selection period $T_{SE}$ to $V_{DSH}$ to flow the saturation current $I_{DS}k$, the potential $V_{HIGH}(>V_{SS})$ is applied to the power supply scanning line $Z_i$. In addition, the data driver 3 appropriately supplies a current from the signal line $Y_j$ such that charges corresponding to the saturation current $I_{DS}k$ are stored in the capacitor 24 in the gate-to-source path and the source of the transistor 23.

As described above, according to this embodiment, to supply a relatively large current to the pixels $P_{1,1}$ to $P_{m,n}$ of the organic EL display panel 2 such that the drain-to-source current of each transistor 23 becomes the saturation current during each selection period $T_{SE}$, the potential $V_{HIGH}$ having a relatively high level as before is applied to the power supply scanning lines $Z_1$ to $Z_n$. For this reason, the steady state delay of the voltage of the signal line $Y_j$ due to the parasitic capacitance can be suppressed. During the nonselection period $T_{NSE}$, the potential $V_{LOW}$ having a relatively low level is applied to the power supply scanning lines $Z_1$ to $Z_n$ to set the drain-to-source voltage level $V_{DS}$ of the transistor 23 in a nonsaturation region. For this reason, the drain-to-source current level $I_{DS}$ of the transistor 23 can be made as low as several ten nA to several μA.

Hence, without using any complex organic EL display panel, unlike the prior art, the current of low level of several ten nA to several μA, which is necessary for the organic EL elements $E_{1,1}$ to $E_{m,n}$ to emit light, can be supplied to them. Any decrease in signal write efficiency due to the parasitic capacitance, which is caused by an insufficient current driving capability of the transistors 21, 22, and 23 made of amorphous silicon, can be suppressed. Accordingly, an organic EL display apparatus 1 that realizes low manufacturing cost and high yield can be realized.

The present invention is not limited to the above-described embodiment, and various changes and modifications can be made within the spirit and scope of the present invention.

Figure 6A:
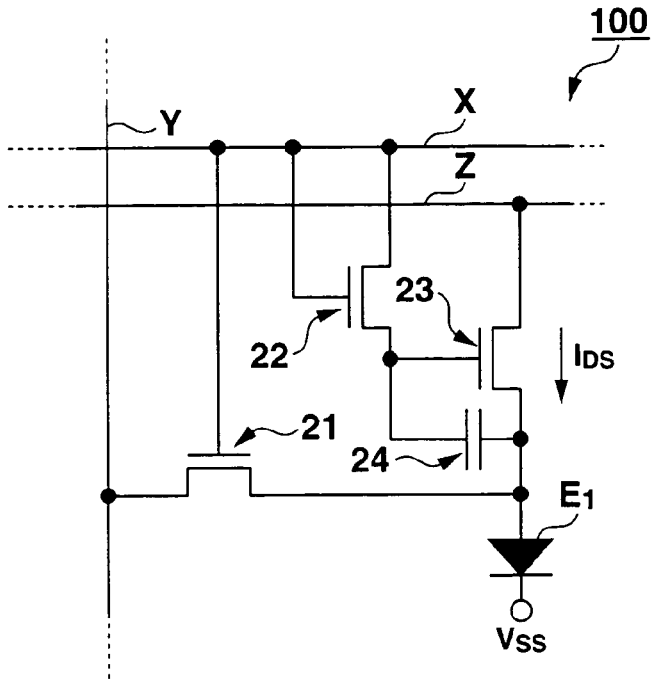
FIG. 6A is a circuit diagram showing an equivalent circuit corresponding to one pixel of another organic EL display apparatus.
Figure 6B:
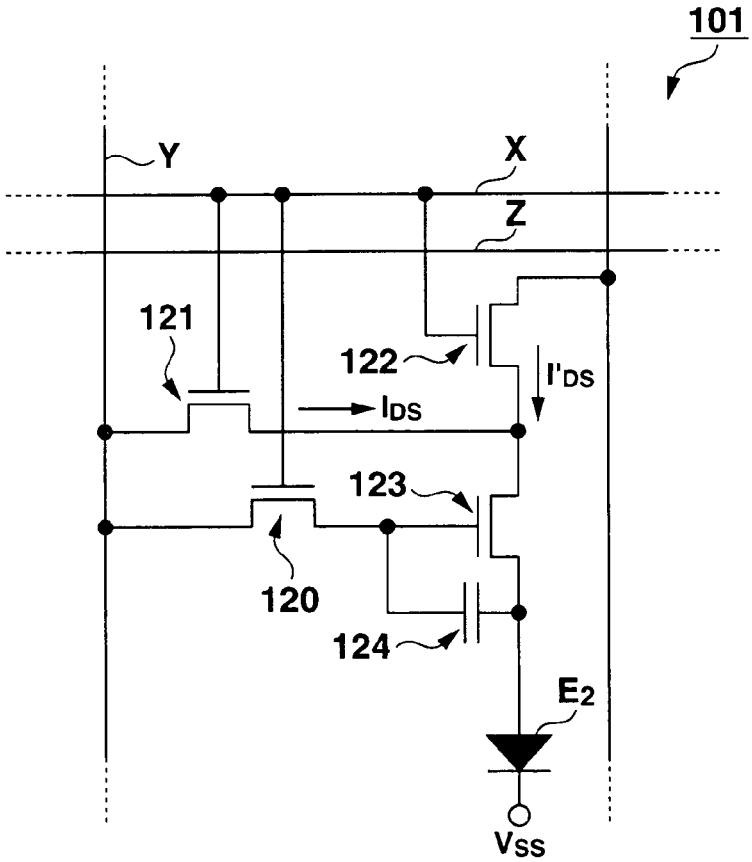
FIG. 6B is a circuit diagram showing an equivalent circuit having four switching elements in one pixel.
Figure 7:
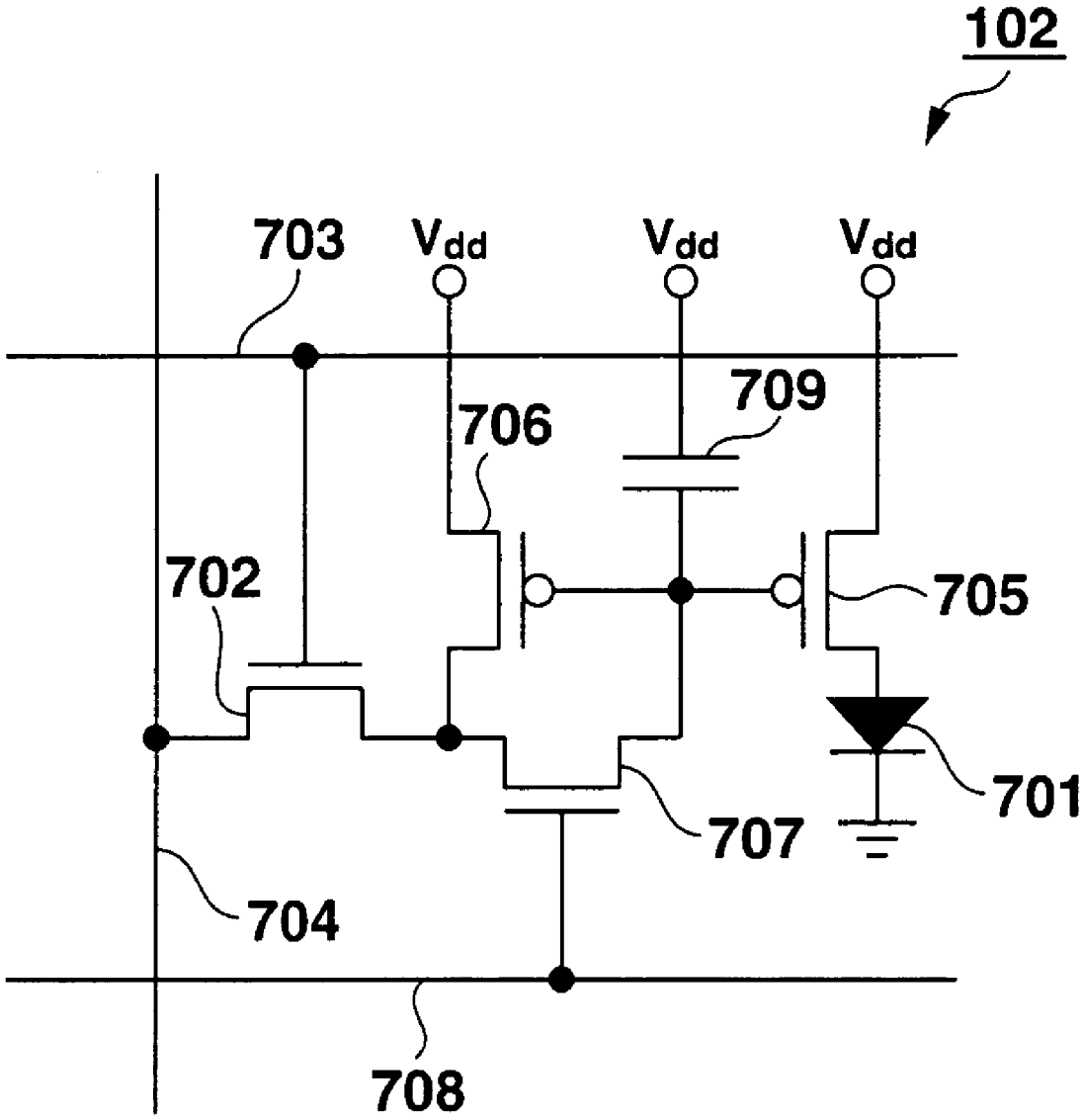
FIG.7 (RELATED ART)
FIG. 7 is a view showing an equivalent circuit with current mirror corresponding to one pixel of an organic EL display apparatus related to the present invention.

For this reason, in the embodiment, the main part of the organic EL display panel 2 is formed from three transistors serving as switching elements corresponding to one pixel. However, the present invention is not limited to this and can be applied to any organic EL display apparatus by current gray level designation. For example, as shown in FIG. 6A, the drain electrode 22*d* of the transistor 22 of each of pixel circuits $D_{k,1}$ to $D_{k,n}$ of the kth row ($1 \leqq k \leqq m$) of an organic EL display apparatus 100 may be connected to a selection scanning line $X_k$. The remaining components of the organic EL display apparatus 100 are the same as those of the organic EL display apparatus 1 shown in FIG. 1. As shown in FIG. 6B, an organic EL display apparatus 101 in which the main part of a switching element is formed from four transistors may be applied. In the organic EL display apparatus 101, while transistors 120 and 121 of a predetermined row are selected in accordance with a selection signal output through the selection scanning line $X_k$, and the power supply scanning line $Z_k$ of the kth row applies the OFF voltage to each transistor 122 during the selection period of the kth row, the ON potential is output from each of the signal lines $Y_1$ to $Y_n$ to the gate of each transistor 123 through the transistor 120, and the drain current $I_{DS}$ flows to the transistor 123 through the transistor 121. At this time, the drain current $I_{DS}$ is set to a voltage with which the drain-to-source voltage of the transistor 123 reaches the saturation region. Charges corresponding to the drain current $I_{DS}$ are stored in a capacitor 124. Next, during the nonselection period of the kth row, the OFF voltage is applied to the transistors 120 and 121 through the selection scanning line $X_k$, and the power supply scanning line $Z_k$ applies the ON voltage to the drain of each transistor 122, with which the drain-to-source voltage of each transistor 122 is set in the nonsaturation region. Accordingly, each transistor 123 flows a nonsaturation drain current $I'_{DS}$ in accordance with the gate-to-source potential by the charges held in the capacitor 124. When the current value of the current flowing to the signal lines $Y_1$ to $Y_n$ is increased during the selection period, any delay due to the parasitic capacitance can be suppressed, and the current value of the current that flows to an organic EL element E2 during the nonselection period can be made small in accordance with the desired luminance.

More specifically, even for the 4-transistor equivalent circuit 101, the potential $V_{LOW}$ of relatively low level is applied to a power supply scanning line Z during the selection period $T_{SE}$ as before. During the nonselection period $T_{NSE}$, the potential $V_{LOW}$ of relatively low level, with which the drain-to-source voltage level $V_{DS}$ of the transistor 123 becomes the nonsaturation region, is applied to the power supply scanning line Z. With the potential $V_{LOW}$, the drain-to-source current level $I_{DS}$ of the transistor 123 becomes a low level of several ten nA to several μA which is necessary for the organic EL element E2 to emit light.

In this case, a current flows to the organic EL element E2 during the selection period $T_{SE}$ so the organic EL element emits light at an intensity higher than that during the nonselection period $T_{NSE}$. However, since the selection period $T_{SE}$ is much shorter than the nonselection period $T_{NSE}$, the influence of the difference in light emission intensity is small.

The present invention can also be applied to an organic EL display panel using transistors made of polysilicon.

A transistor made of polysilicon has a sufficient current driving capability. Hence, the decrease in signal write efficiency due to the influence of the parasitic capacitance, which may occur in driving a transistor of amorphous silicon, is small. However, since the current driving capability of the transistor made of polysilicon is too large, the dimensions of the transistor becomes small. As a result, the process accuracy varies. This variation in process accuracy increases the variation in luminance. In this case, when the present invention is applied to the organic EL display panel, the above-described influence can be reduced.

According to the present invention, a light emission signal (current) of level (e.g., low level of several ten nA to several μA) sufficient for a light-emitting element to emit light can be supplied to the light-emitting element without complicating the arrangement of the display apparatus. Hence, a display apparatus that realizes low power consumption and manufacturing cost and high yield, and a driving method for the display apparatus can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display apparatus comprising:

a plurality of pixel circuits;

a plurality of light-emitting elements each of which is arranged for a corresponding one of the pixel circuits and emits light at a luminance corresponding to a driving current;

luminance gray level designation means for supplying, through a signal line to a respective one of the pixel circuits, a gray level designation current having a current value larger than that of the driving current during a selection period to store a luminance gray level of the light-emitting element in the pixel circuit; and current value switching voltage output means for outputting a first voltage to the pixel circuit to cause the luminance gray level designation means to supply the gray level designation current through the signal line to the pixel circuit during the selection period, and for outputting a second voltage having a potential different from that of the first voltage to the pixel circuit during a nonselection period, thereby modulating a current output from the pixel circuit based on the luminance gray level stored in the pixel circuit to supply the driving current to the pixel circuit.

2. An apparatus according to claim 1, wherein each of the pixel circuits includes a first switching element which has a control terminal and a current path having one end connected to the current value switching voltage output means and the other end connected to the light-emitting element, a second switching element which has a control terminal and a current path having one end connected to the current value switching voltage output means and the other end connected to the control terminal of the first switching element, and a third switching element which has a control terminal and a current path having one end connected to the other end of the current path of the first switching element.

3. An apparatus according to claim 2, wherein the current value switching voltage output means outputs the first voltage to the one end of the current path of the first switching element so that the gray level designation current that flows to the current path of the first switching element becomes a saturation current during the selection period.

4. An apparatus according to claim 2, wherein the current value switching voltage output means outputs the second voltage to the one end of the current path of the first switching element so that the driving current that flows to the current path of the first switching element becomes a nonsaturation current during the nonselection period.

5. An apparatus according to claim 2, wherein the luminance gray level designation means is connected to the other end of the current path of the third switching element.

6. An apparatus according to claim 2, further comprising selection scanning means for outputting a selection signal to the control terminal of the second switching element and the control terminal of the third switching element.

7. An apparatus according to claim 1, wherein each of the pixel circuits includes a first switching element which has a control terminal and a current path having one end connected to the current value switching voltage output means and the other end connected to the light-emitting element, a second switching element which has a control terminal and a current path having one end connected to a selection scanning means and the other end connected to the control terminal of the first switching element, and a third switching element which has a control terminal and a current path having one end connected to the other end of the current path of the first switching element.

8. An apparatus according to claim 1, wherein the second voltage is lower than the first voltage.

9. An apparatus according to claim 1, wherein each of the pixel circuits has a transistor connected in series with the light-emitting element, the first voltage is a saturation voltage that saturates a path between a source electrode and a drain electrode of the transistor, and the current value of the driving current complies with a voltage value of a gate voltage applied to a gate electrode of the transistor.

10. An apparatus according to claim 1, wherein each of the pixel circuits has a transistor connected in series with the light-emitting element, the second voltage is applied between a source electrode and a drain electrode of the transistor, and the current value of the driving current complies with a voltage value of the second voltage and a voltage value of a gate voltage applied to a gate electrode of the transistor.

11. A driving method for a display apparatus which comprises a plurality of pixel circuits and causes light-emitting elements each of which is arranged for a corresponding one of the pixel circuits to emit light in accordance with a predetermined driving current to execute display, comprising:

outputting a first voltage to a respective one of the pixel circuits to supply a gray level designation current having a current value larger than that of the driving current through a signal line to the pixel circuit during a selection period and store, in the pixel circuit, a luminance gray level of the light-emitting element corresponding to the current value of the gray level designation current; and outputting a second voltage having a potential different from that of the first voltage to the pixel circuit during a nonselection period to modulate the driving current output from the pixel circuit based on the luminance gray level stored in the pixel circuit.

12. A method according to claim 11, wherein each of the pixel circuits includes a first switching element which has a control terminal and a current path having one end to which one of the first and second voltages is selectively input and the other end connected to the light-emitting element, a second switching element which has a control terminal and a current path having one end to which the first voltage is input during the selection period and the other end connected to the control terminal of the first switching element, and a third switching element which has a control terminal and a current path having one end connected to the other end of the current path of the first switching element.

13. A method according to claim 11, wherein each of the pixel circuits includes a first switching element which has a control terminal and a current path having one end to which one of the first and second voltages is selectively input and the other end connected to the light-emitting element, a second switching element which has a control terminal and a current path, in which a selection scanning signal is input to one end of the current path and the control terminal during the selection period, and the other end is connected to the control terminal of the first switching element, and a third switching element which has a control terminal and a current path having one end connected to the other end of the current path of the first switching element.

14. A method according to claim 11, wherein the second voltage is lower than the first voltage.

15. A method according to claim 11, wherein each of the pixel circuits has a transistor connected in series with the light-emitting element, the first voltage is a saturation voltage that saturates a path between a source electrode and a drain electrode of the transistor, and the current value of the driving current complies with a voltage value of a gate voltage applied to a gate electrode of the transistor.

16. A method according to claim 11, wherein the pixel circuit has a transistor connected in series with the light-emitting element, the second voltage is applied between a source electrode and a drain electrode of the transistor, and the current value of the driving current complies with a voltage value of the second voltage and a voltage value of a gate voltage applied to a gate electrode of the transistor.

* * * * *